United States Patent [19]

Gangi

[11] 4,092,838

[45] June 6, 1978

[54] YARN GUIDE TUBES FOR WARP KNITTING MACHINES

[75] Inventor: Robert J. Gangi, Emerson, N.J.

[73] Assignee: Joan Manufacturing Corporation, Waldwick, N.J.

[21] Appl. No.: 817,922

[22] Filed: Jul. 22, 1977

[51] Int. Cl.[2] ..... D04B 23/00

[52] U.S. Cl. ..... 66/214; 66/207

[58] Field of Search ..... 66/203, 214, 207, 87, 66/129

[56] References Cited

U.S. PATENT DOCUMENTS

| | | | |
|---|---|---|---|
| 2,635,443 | 4/1953 | Lambach | 66/207 |
| 2,957,326 | 10/1960 | Porter | 66/214 |
| 2,991,640 | 7/1961 | MacCaffray | 66/191 |
| 3,001,388 | 9/1961 | MacCaffray | 66/84 |
| 3,019,625 | 2/1962 | Hubbard | 66/84 |
| 3,707,853 | 1/1973 | Lindner et al. | 66/84 |
| 3,943,733 | 3/1976 | Wily | 66/125 |

FOREIGN PATENT DOCUMENTS

| | | | |
|---|---|---|---|
| 661,298 | 4/1963 | Canada | 66/214 |

*Primary Examiner*—Ronald Feldbaum

*Attorney, Agent, or Firm*—Bell, Seltzer, Park & Gibson

[57] ABSTRACT

The present yarn guide tubes are fixed on one face of profile plates which are in turn carried on a support bar operated from the carrier rods of the knitting machine. The centers of the yarn guide tubes are spaced the same distance as the spacing of the needles and the free ends are sufficiently spaced apart to at times to permit the needles to pass therebetween. Selective positions on the support bar, or the entire support bar, may be provided with the profile plates and inlay yarns are fed through the selected tubes where it is desired to produce zig-zag striping, diamonds and various other motifs in the knit fabric.

6 Claims, 5 Drawing Figures

YARN GUIDE TUBES FOR WARP KNITTING MACHINES

This invention relates generally to yarn guide tubes for warp knitting machines and more particularly to the mounting of the yarn guide tubes in fixed relationship to each other so as to insure their proper positioning during each of the inlaying operations and to facilitate the knitting of various types of different patterns of inlay yarn.

The yarn guide tubes of warp knitting machines of the type adapted to form inlaid patterns of inlay yarns on one face of the knit fabric are conventionally supported, either individually or in small groups, on the lower ends of rod or wire supports which are somewhat flexible and are supported at their upper ends on the serrated or notched carrier rods. These yarn guide tubes are moved or shogged laterally relative to the needles and are moved vertically so that the needles pass therebetween as the inlay yarn patterns are formed on one face of the knit fabric. Because of machine vibration and excessive yarn tension, the yarn guide tubes may become misplaced from the proper locations and may engage the needles causing a jam-up of the machine or the guide tubes may inlay the yarns to the wrong needles. Also, when it is desired to knit a different inlaid pattern, it is necessary to manually move the guide tube supports to new locations on the carrier rods and this can be a time consuming operation.

With the foregoing in mind, it is an object of the present invention to provide an improved mounting for yarn guide tubes so that they are maintained in the proper spaced relationship to the needles and are accurately positioned during the formation of inlay patterns on the knit fabric. The present profile plate mounting of the yarn guide tubes also facilitates the changing of the inlay pattern being knit.

In accordance with the present invention, the upper end portions of a plurality of adjacent yarn guide tubes are fixed to one face of individual profile plates. The profile plates are in turn supported in selective positions or along the entire length of a tube guide support bar extending parallel to the needles. Spaced apart support means is provided for the tube guide support bar and operatively connects the tube guide support bar to the carrier rod of the knitting machine. The centers of the yarn guide tubes are spaced apart the same distance as the spacing of the needles and the lower free ends of adjacent yarn guide tubes are sufficiently spaced apart to at times permit the needles to pass therebetween. The upper end portions of the yarn guide tubes are circular in cross section and the lower end portions are bent inwardly from opposite sides to provide sufficient space for the needles to pass between adjacent yarn guide tubes.

The positive mounting of the profile plates and the yarn guide tubes across either selected sections of or across the entire length of the tube guide support bar insures the proper positioning of the yarn guide tubes relative to each other and relative to the needles so that the positioning of the yarn guide tubes is accurately controlled during the knitting operation. Also, the profile plate mounting of the yarn guide tubes facilitates the changing from one inlay pattern to another because it is merely necessary to selectively thread the inlay yarns through the inlay tubes which are to be utilized in the knitting of a particular pattern and the need to reposition the individual yarn guide tubes is eliminated.

Other objects and advantages will appear as the description proceeds when taken in connection with the accompanying drawings, in which.

The profile plate mounted yarn guide tubes of the present invention are illustrated in association with a conventional warp knitting machine of the type manufactured by Cidega Machine Corporation. This type of machine is adapted to form a base or ground fabric including parallel warp stitch chains which are formed by warp yarns fed to the needles with each reciprocation thereof. Weft inlay yarns are fed by yarn guide tubes and are interconnected with the warp stitch chains on one face of the fabric to provide various staggered back-and-forth patterns on one face of the knit fabric. However, it is to be understood that the present profile plate mounted yarn guide tubes may be utilized in connection with other types of warp knitting machines.

Figure 1:
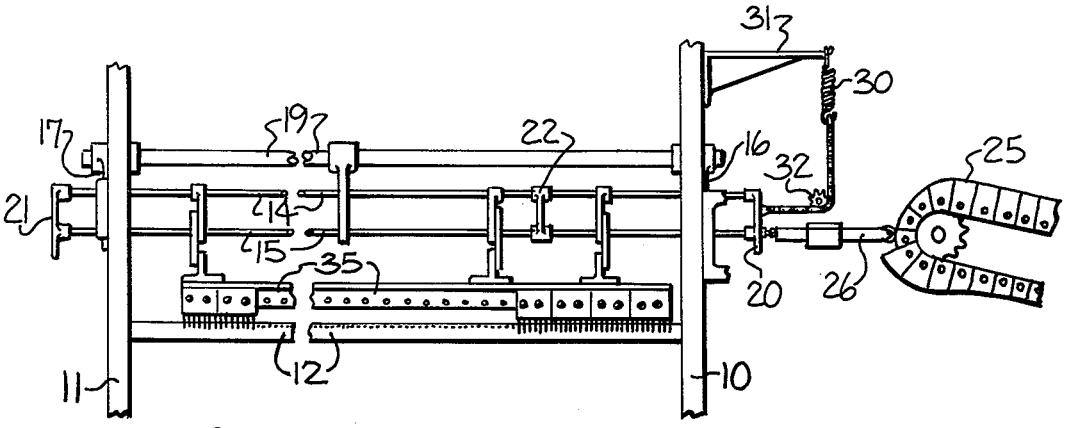
FIG. 1 is a somewhat schematic fragmentary front elevational view of the warp knitting machine and illustrating the present profile plate mounting of the yarn guide tubes associated therewith.

As illustrated in FIG. 1, the warp knitting machine includes a pair of opposite end frames 10, 11 with a transversely extending needle bed 12 supported therebetween. A row of needles 13 (FIG. 2) is supported for horizontal reciprocation on the needle bed 12. Carrier rod means, in the form of a pair of carrier rods 14, 15, is supported for longitudinal movement in carrier guide plates 16, 17 supported for vertical reciprocation on the respective end frames 10, 11. The carrier rods 14, 15 are supported for longitudinal movement intermediate their ends in one or more intermediate guide plates 18 and the guide plates 16, 17, 18 are supported at their upper ends on a support shaft 19 which extends between the end frames 10, 11. Opposite ends of the carrier rods 14, 15 are fixed in end brackets 20, 21 and the medial portions of the carrier rods 14,15 are connected by connector brackets 22.

Means is provided for imparting step-by-step racking movement to the carrier rods 14, 15 and includes a pattern chain 25 which is rotated in timed relationship and a step-by-step manner with operation of the needles 13. The chain 25 is made up of interconnected links or knuckles which vary in height or length to impart movement to one end of a push bar or rod 26 supported for sliding movement intermediate its ends and with the other end of the push rod 26 engaging the end bracket 20. The carrier rods 14, 15 and push rod 26 are resiliently urged to the right in FIG. 1 by means of a chain 28, one end of which is suitable connected to the end bracket 20 and the other of which is connected to the lower end of a tension spring 30. The upper end of the tension spring 30 is suitably connected to a spring perch 31 and the medial portion of the chain 28 passes beneath an idler sprocket 32.

Figure 2:
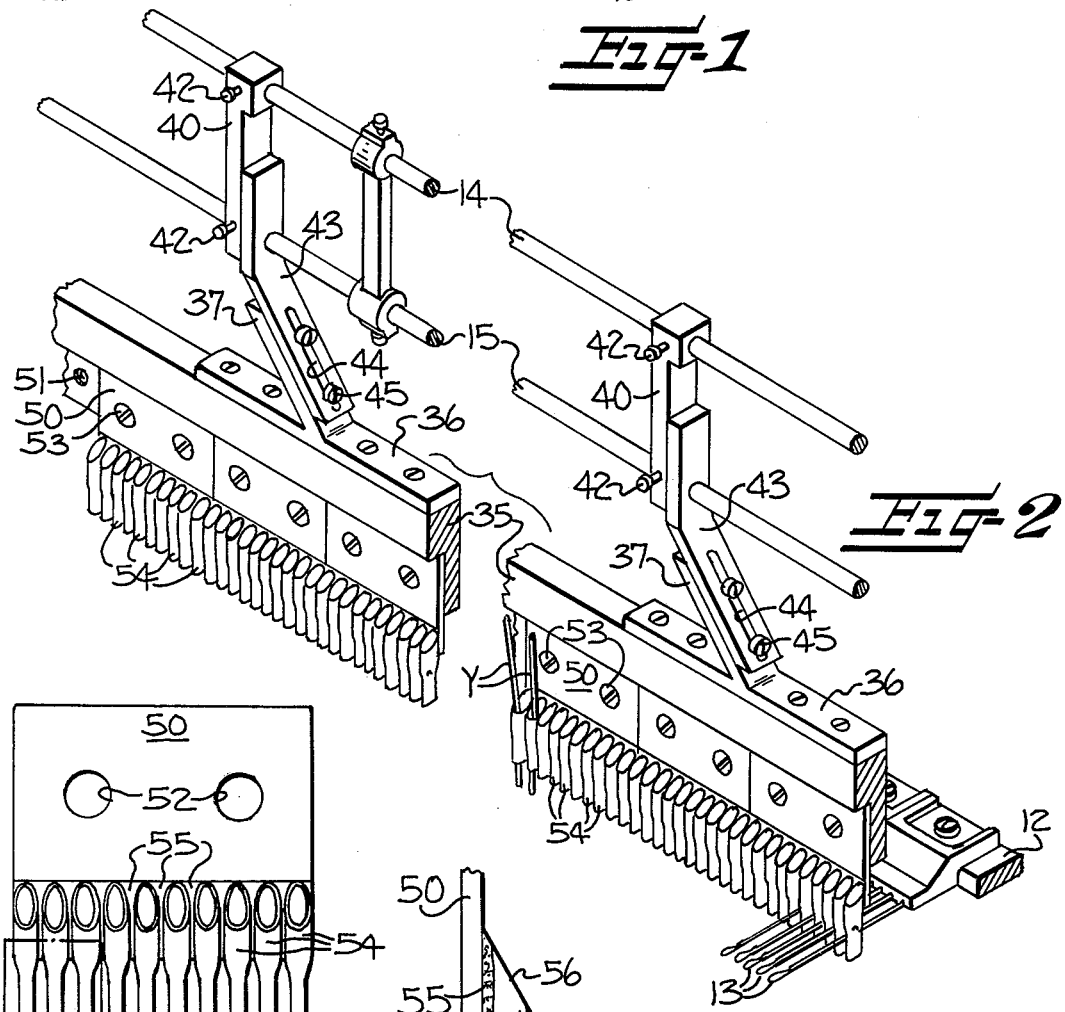
FIG. 2 is an enlarged fragmentary isometric view illustrating the manner in which the profile plate mounted yarn guide tubes are supported on and controlled by the carrier rod means.
Figure 3:
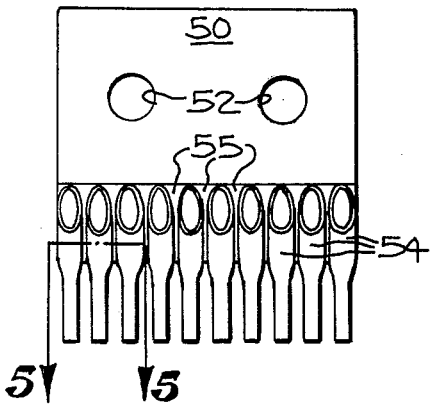
FIG. 3 is an enlarged front elevational view of one of the profile plates, removed from the support bar, and illustrating a plurality of yarn guide tubes secured thereto and depending downwardly therefrom.

In accordance with the present invention, improved means is provided for feeding inlaying weft yarns to the needles and includes a tube guide support bar 35 extending parallel to and above the row of needles 13. Spaced apart support means is provided for the tube guide support bar 35 and includes support brackets 36 fixed on the tube guide support bar 35 and including upwardly extending portions 37 (FIG. 2). Spaced apart support arms 40 are supported for longitudinal adjustment on the carrier rods 14, 15 by set screws 42 and include downwardly extending portions 43. Means is provided for connecting together the downwardly extending portions 43 of the support arms 40 and the upperwardly extending portions 37 of the support brackets 36 for longitudinal adjustment of the tube guide support bar 35 relative to the carrier rods 14, 15 and includes elongated adjustment slots 44 in the portions 43 and locking screws 45.

As illustrated in FIG. 2, one face of each of the profile plates 50 is removably secured to the tube guide support bar 35. The tube guide support bar 35 is provided with threaded holes 51 at spaced points therealong and each of the profile plates 50 is provided with holes 52 which mate with the threaded holes 51. Mounting screws 53 are adapted to penetrate the holes 52 in the plates 50 and their inner ends are secured in the threaded holes 51 so that the profile plates 50 are removably secured to the tube guide support bar and in proper spaced position therealong.

The upper end portions of a plurality of yarn guide tubes 54 are fixed to the other face of each of the profile plates 50 and include lower end portions extending downwardly from the lower edge of the profile plates to define lower free ends for directing inlaying weft yarns Y (FIG. 2) therethrough. The upper portions of the yarn guide tubes 54 are circular in cross section and are fixed on the profile plate 50 in substantially side-by-side relationship by means of solder, indicated at 55. The centers of adjacent yarn guide tubes 54 are spaced apart vertically the same distance as the spacing of the needles 13. Also, the lower portions of adjacent yarn guide tubes 54 are sufficiently spaced apart to at times permit the needles to pass therebetween, as illustrated in FIG. 2.

Figure 4:
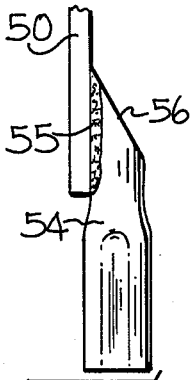
FIG. 4 is a fragmentary end elevational view looking inwardly at the left-hand end of FIG. 3 and illustrating the manner in which the upper ends of the guide tubes are fixed to one face of the profile plate.
Figure 5:
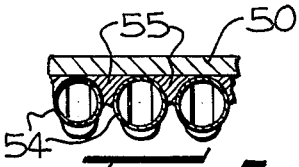
FIG. 5 is an enlarged fragmentary horizontal sectional view taken substantially along the line 5—5 in FIG. 3.

In order to provide sufficient space for the passage of the needles therebetween, opposite sides of the lower portions of each of the yarn tubes 54 are flattened or bent inwardly so that the lower ends of the yarn tubes 54 are elongated in cross section. As best illustrated in FIG. 4, the upper ends of the guide tubes 54 are cut at an angle inclined downwardly and away from the profile plate 50, as indicated at 56. While this angle may be varied, it has been found that the feeding of the inlay yarns into and through the yarn guide tubes 54 is facilitated when this angle is approximately 30° from the vertical center of the yarn guide tubes.

As has been stated, the spacing of the guide tubes 54 is the same as the spacing of the needles and in the present instance each profile plate 50 is two inches wide with ten guide tubes supported on each plate 50. Of course, profile plates of different width and supporting differently spaced guide tubes will be provided for use on knitting machines having different needle spacing.

With the profile plate mounted inlay yarn guide tubes 54 of the present invention supported in either spaced locations or entirely across the tube guide support bar 35, the individual guide tubes 54 are selectively threaded with the inlay yarns Y in accordance with the pattern to be produced. These inlay yarns Y are thereby maintained in the proper spaced relationship to be fed to the warp knit stitch chains forming the base or ground fabric and incorporated therein and the guide tubes and inlay yarns are not moved out of the proper positions, either by vibration from the knitting machine or unusual tension on the inlay yarns. When it is desired to knit a fabric with a different inlay pattern thereon, the yarn guide tubes can be merely rethreaded in a very short period of time and it is not necessary to replace and reposition individual yarn guide tubes, as has been the prior practice. Also, the profile plates supported yarn guide tubes of the present invention can be added to conventional warp knitting machines without requiring major modifications thereof.

In the drawing and specification there has been set forth a preferred embodiment of the invention, and although specific terms are employed they are used in a generic and descriptive sense only and not for purposes of limitation, the scope of the invention being defined in the claims.

That which is claimed is:

1. In a knitting machine including a row of needles supported for longitudinal reciprocation, carrier rod means supported for parallel movement relative to said needles, and means for imparting step-by-step racking movement to said carrier rod means, the combination therewith of improved means for feeding inlaying yarns to said needles, said inlaying yarn feeding means comprising (a) a tube guide support bar extending parallel to said needles, (b) spaced apart support means for said tube guide support bar, each of said support means including one end fixed on said carrier rod means and an opposite end fixed on said tube guide support bar, (c) a plurality of profile plates including one face removably secured to said tube guide support bar, and (d) a plurality of yarn guide tubes including upper end portions fixed to the other face of each of said profile plates and being circular in cross section, said yarn guide tubes including lower end portions extending downwardly from said profile plates to define free ends for directing inlaying yarns to said needles, the centers of the free ends of adjacent yarn guide tubes being spaced the same distance apart as the spacing of said needles said lower end portions being bent inwardly from opposite sides so that, the free lower ends of adjacent yarn guide tubes are elongated in cross-section and are sufficiently spaced apart to at times permit the needles to pass therebetween.

2. In a warp knitting machine according to claim 1 wherein said upper end portions of said yarn guide tubes are soldered in position on said other face of said profile plates.

3. In a warp knitting machine according to claim 1 wherein said tube guide support bar is provided with threaded holes at spaced locations therealong, wherein each of said profile plates is provided with holes mating with said threaded holes, and including screws adapted to penetrate said holes in said profile plates and to be secured in said threaded holes to removable secure said profile plates to said tube guide support bar.

4. In a warp knitting machine according to claim 1 wherein the upper ends of said guide tubes are cut at an angle inclined downwardly and away from said profile plate.

5. In a warp knitting machine according to claim 1 wherein said spaced apart support means is supported for longitudinal adjustment on said carrier rod means, and wherein said spaced apart support means includes means for adjusting the distance said tube guide support bar is supported below said carrier rod means.

6. In a warp knitting machine according to claim 6 wherein said spaced apart support means comprises support arms supported for longitudinal adjustment on said carrier rod means and including portions extending downwardly therefrom, support brackets fixed on said tube guide support bar and including portions extending upwardly therefrom, and means connecting together said downwardly extending portions of said support arms and said upwardly extending portions of said support brackets for longitudinal adjustment thereof.

* * * * *

UNITED STATES PATENT OFFICE

CERTIFICATE OF CORRECTION

PATENT NO. : 4,092,838

DATED : June 6, 1978

INVENTOR(S) : Robert J. Gangi

It is certified that error appears in the above-identified patent and that said Letters Patent are hereby corrected as shown below:

Claim 6, line 1, change "6" to -- 5 --.

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*